United States Patent [19]

Sueyoshi et al.

[11] Patent Number: 4,932,899

[45] Date of Patent: Jun. 12, 1990

[54] ELECTRICAL CONNECTOR

[75] Inventors: Tadahiro Sueyoshi; Kenji Takenouchi; Toshihiko Makita; Keishi Jinno, all of Shizuoka, Japan

[73] Assignee: Yazaki Corporation, Tokyo, Japan

[21] Appl. No.: 358,764

[22] Filed: May 30, 1989

[30] Foreign Application Priority Data

May 31, 1988 [JP] Japan ..... 63-131706

[51] Int. Cl.[5] ..... H01R 13/40

[52] U.S. Cl. ..... 439/595; 439/594

[58] Field of Search ..... 439/594, 595, 598

[56] References Cited

U.S. PATENT DOCUMENTS

| | | | |
|---|---|---|---|
| 4,557,542 | 10/1985 | Coller et al. | 439/595 |
| 4,565,416 | 1/1986 | Rudy et al. | 439/595 |
| 4,660,915 | 4/1987 | Mantlik | 439/595 |
| 4,784,617 | 11/1988 | Oda | 439/595 |
| 4,806,123 | 2/1989 | Konishi et al. | 439/595 |
| 4,820,198 | 4/1989 | Lulko et al. | 439/595 |

*Primary Examiner*—P. Austin Bradley

*Attorney, Agent, or Firm*—Sughrue, Mion, Zinn, Macpeak & Seas

[57] ABSTRACT

An electrical connector includes a housing having a terminal-receiving chamber. When a terminal is fully inserted in the chamber, the terminal is lockingly engaged with an elastic retainer arm mounted within the chamber, so that the terminal is prevented from withdrawal from the chamber. A spacer is inserted into the chamber so as to be received in a space formed between the retainer arm and an inner surface of the chamber. The spacer is elastically deformable by the housing when the spacer is inserted into the chamber. The terminal is engageable with the retainer arm to elastically deform the same to reduce the space when the terminal is incompletely inserted in the chamber, so that the spacer in its deformed condition is prevented from being inserted into the space.

6 Claims, 3 Drawing Sheets

ELECTRICAL CONNECTOR

BACKGROUND OF THE INVENTION

1. Field of the Invention

This invention relates to an electrical connector of the type which positively prevents a terminal from being incompletely inserted therein.

2. Prior Art

In a conventional electrical connector shown in FIGS. 6(*a*), 6(*b*) and 7, an elastic retainer arm 13 is formed on an inner surface of a terminal-receiving chamber 12 of a connector housing 11. When a terminal 14 is fully inserted into the terminal-receiving chamber 12, the distal end of the retainer arm 13 is engaged with a shoulder 14*a* of the terminal 14 to thereby prevent the terminal 14 from being withdrawn from the terminal-receiving chamber 12. Then, a plate-like spacer 15 is inserted into the terminal-receiving chamber 12 so that its front end can be received in a space S formed between the inner surface 12*a* of the connector housing 11 and the retainer arm 13. The spacer 15 detects the amount of flexing of the retainer arm 13 toward the inner surface 12*a* to determine whether the terminal 14 is inserted into the terminal-receiving chamber 12 fully or incompletely.

The front end 15*a* of the plate-like spacer 15 is tapered so that it can be easily received in the space S. Therefore, as shown in FIG. 6(*b*), even when the terminal 14 is incompletely inserted into the terminal-receiving chamber 12, the spacer 15 can be inserted in the space S. Therefore, there is a risk that such incomplete insertion of the terminal 14 can be overlooked at the time of assembling the electrical connector.

SUMMARY OF THE INVENTION

It is therefore an object of this invention to provide an electrical connector in which it can be clearly determined, through the insertion of a spacer into the electrical connector, whether the terminal has been inserted into the electrical connector fully or incompletely, thus positively preventing such incomplete insertion.

According to the present invention, there is provided an electrical connector comprising:

(a) a housing having (i) a terminal-receiving chamber into which a terminal is adapted to be inserted, and (ii) an elastic retainer arm mounted within the chamber and being engageable with the terminal to lock the terminal against withdrawal from the chamber, the retainer arm cooperating with an inner surface of the chamber to form a space therebetween, the retainer arm being elastically deformable by the terminal to reduce the space when the terminal is incompletely inserted in the chamber; and (b) a spacer insertable into the chamber so as to be received in the space, the spacer being elastically deformable by the housing when the spacer is inserted into the chamber;

(c) the terminal being engageable with the retainer arm to elastically deform the same to reduce the space when the terminal is incompletely inserted in the chamber, so that the spacer in its elastically-deformed condition is prevented from being inserted into the space.

BRIEF DESCRIPTION OF THE DRAWINGS

FIG. 4(*d*) is a cross-sectional view taken along the line A—A of FIG. 4(d);

DESCRIPTION OF THE PREFERRED EMBODIMENT OF THE INVENTION

The invention will now be described with reference to the drawings.

Figure 1:
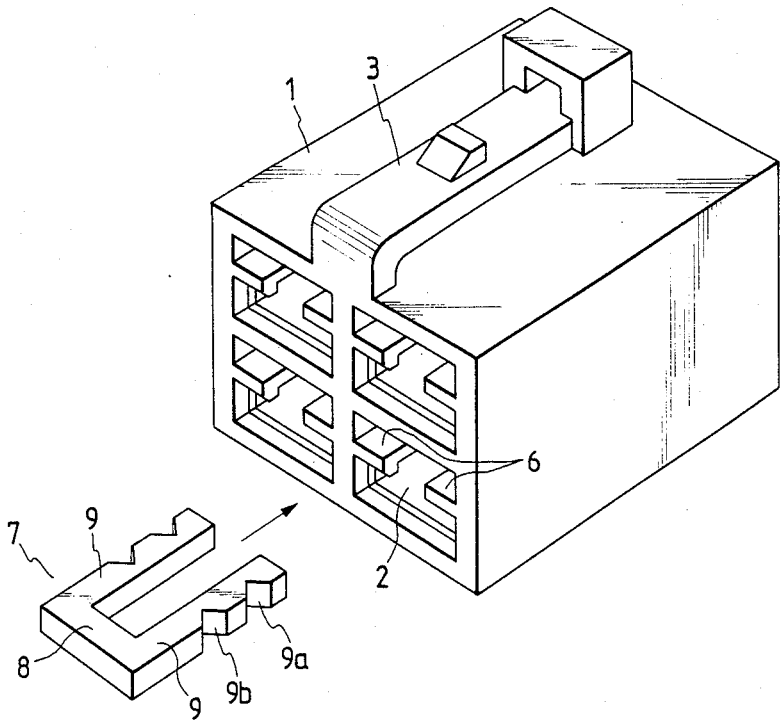
FIG. 1 is a perspective view of an electrical connector provided in accordance with the present invention.
Figure 2:
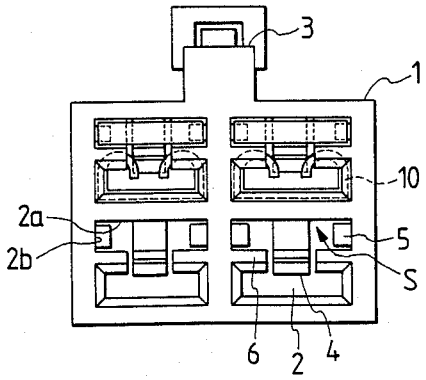
FIG. 2 is a front-elevational view of the electrical connector.
Figure 3:
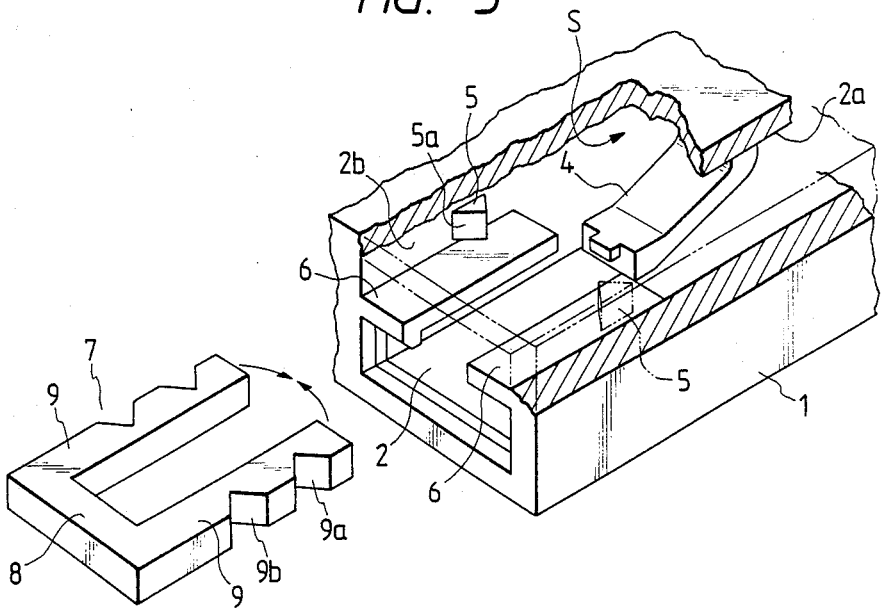
FIG. 3 is a partly-broken, perspective view of a portion of the electrical connector.
Figure 4A:
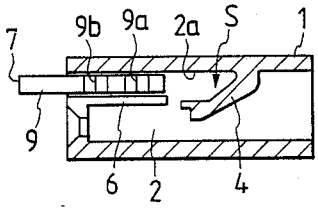
FIGS. 4(*a*) to 4(*c*) are cross-sectional views of a portion of the electrical connector, showing the insertion of a spacer and a terminal into the connector.
Figure 4B:
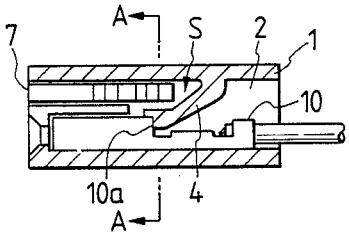
Figure 4C:
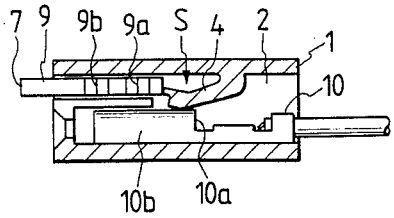
Figure 4D:
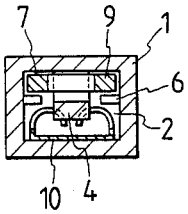

An electrical connector shown in FIGS. 1 to 3 comprises a connector housing 1 having a plurality of terminal-receiving chambers 2. Formed on an upper outer surface of the housing 1 is a locking arm 3 which is engageable with a mating housing (not shown) to provide a locking engagement between the two housings. A resilient or elastic retainer arm 4 is formed on an upper inner surface of wall 2*a* of each terminal-receiving chamber 2 and extends therefrom obliquely downwardly toward one end of the chamber 2. A pair of opposed projections 5 and 5 are formed respectively on the opposite inner side surfaces 2*b* and 2*b* of the terminal-receiving chamber 2; each projection 5 being of a triangular cross-section having a pair of front and rear tapered surfaces 5*a* and 5*a* toward the center of the chamber. A space S is formed between the upper inner surface 2*a* of the terminal-receiving chamber 2 and the retainer arm 3. A pair of opposed guide portions 6 and 6 each in the form of a plate, are formed respectively on the opposite inner side surfaces 2*b* and 2*b* and extend therealong, each guide portion 6 being disposed at a level below a projection 5. The guide portions 6 and 6 serve to guide the insertion of a spacer 7.

The spacer 7 includes a U-shaped body defined by a base 8 and a pair of parallel spaced, opposed arms 9 and 9 interconnected at their one ends by the base 8, each arm 9 being elastic. The pair of arms 9 and 9 are elastically deformable toward each other as indicated by arrows in FIG. 3. First and second recesses or notches 9*a* and 9*b* of a triangular cross-section are formed in the outer surface of each of the opposed arms 9 and 9 and are spaced from each other along the length thereof. The pair of first recesses 9*a* and 9*a* as well as the pair of second recesses 9*b* and 9*b* are aligned with each other. The pair of projections 5 and 5 can be fitted in the respective first recesses 9*a* and 9*a* and also in the respective second recesses 9*b* and 9*b*. The pair of elastic arms 9 and 9 are so arranged that the two arms 9 and 9 can be elastically deformable toward each other within the space S and that the elastic retainer arm 4 can be elastically deformed upwardly and downwardly between the pair of elastic arms 9 and 9.

The operation of the above electrical connector will now be described.

Figure 5A:
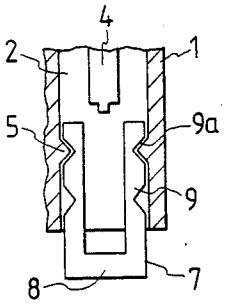
FIGS. 5(*a*) to 5(*c*) are fragmentary views of the electrical connector, showing the operation of the spacer.
Figure 5B:
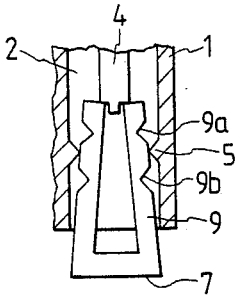
Figure 5C:
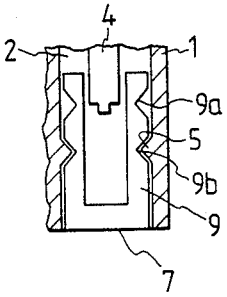
Figure 6A:
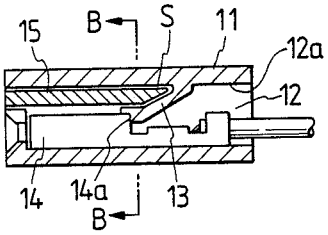
FIG. 6(a) PRIOR ART
FIGS. 6(*a*) and 6(*b*) are cross-sectional views of a portion of a conventional electrical connector.
Figure 6B:
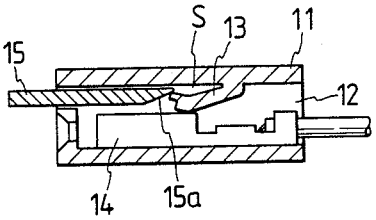
FIG. 6(b) PRIOR ART
Figure 7:
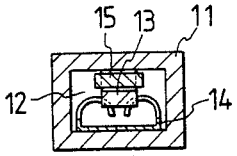
FIG. 7 PRIOR ART
FIG. 7 is a cross-sectional view taken along the line B—B of FIG. 6(i a).

As shown in FIG. 4(*a*), the terminal-receiving chamber 2 is vacant, and the space S between the inner surface 2*a* and the elastic retainer arm 4 is in its fully open condition. In this condition, the pair of elastic arms 9 and 9 of the spacer 7 is inserted into the terminal-receiving chamber 2 along the guide portions 6 and 6 so that the first recesses 9*a* and 9*a* are fitted on the projections 5 and 5, respectively, thereby preliminarily locking the spacer 7 against movement, as shown in FIG. 5(*a*). At this time, the base 8 of the spacer 7 is disposed exteriorly of the terminal-receiving chamber 2. From this, it can be seen that a terminal 10 has not yet been inserted into the terminal-receiving chamber 2 and therefore that the terminal-receiving chamber 2 is still vacant.

Then, as shown in FIG. 4(*b*), the terminal 10 is inserted into the terminal-receiving chamber 2. At this time, if the insertion of the terminal 10 is complete, then the distal end of the elastic retainer arm 4 is engaged with a shoulder 1O*a* of the terminal 10, with the space S being in its open condition, as is the case with the conventional electrical connector. Therefore, when the spacer 7 is further inserted into the terminal-receiving chamber 2, the pair of elastic arms 9 and 9 are elastically deformed toward each other by the pair of projections 5 and 5 (FIG. 5(*b*)), and then the second recesses 9*b* and 9*b* are fitted on the projections 5 and 5, respectively (FIG. 5(*c*)), so that the spacer 7 is locked completely.

In its preliminarily-locked condition of the spacer 7, when the terminal 10 is incompletely inserted into the terminal-receiving chamber 2 as shown in FIG. 4(*c*), the elastic retainer arm 4 is held against an electrical contact portion 1O*b* of the terminal 10, and therefore the space S between the elastic arm 4 and the inner surface 2*a* is reduced, so that the elastic arms 9 and 9 are prevented from being elastically deformed toward each other (see FIG. 5(*b*)).

Therefore, the operator cannot insert the spacer 7 and realizes from this that the terminal 10 is in its incompletely inserted condition. This positively prevents such incomplete insertion of the terminal 10 from being overlooked at the time of assembling the electrical connector.

In the above embodiment, although the elastic arms 9 and 9 have the first and second recesses 9*a* and 9*b* so that the spacer 7 can be disposed at the preliminarily-locked position and the completely-locked position, the first recesses 9*a* and 9*a* may be omitted. Since the distance between the pair of elastic arms 9 and 9 is greater than the width of the elastic arm 4, the inserted terminal 10 can be withdrawn from the electrical connector by inserting a screwdriver or the like into the terminal-receiving chamber 2 and by raising the elastic arm 4 by the driver, with the spacer 7 remaining in its locked condition.

As described above, in the present invention, it can be readily determined from the degree of insertion of the spacer 7 whether the terminal 10 is inserted fully or incompletely into the terminal-receiving chamber 2. Therefore, the terminal will not be withdrawn from the electrical connector during use thereof, thus providing an electrical connector of good quality.

What is claimed is:

1. An electrical connector comprising:

(a) a housing having (i) a terminal-receiving chamber into which a terminal is adapted to be inserted, and (ii) an elastic retainer arm mounted within said chamber and being engageable with the terminal to lock the terminal against withdrawal from said chamber, said retainer arm cooperating with an inner surface of said chamber to form a space therebetween, said retainer arm being elastically deformable by said terminal to reduce said space when the terminal is incompletely inserted in said chamber;

(b) a spacer insertable into said chamber so as to be received in said space, said spacer being elastically deformable; and (c) a deformation element in said housing positioned to elastically deform said spacer when partially inserted in said chamber, whereby said elastically deformed spacer will be blocked by said retainer arm from further insertion into said chamber when said retainer arm is elastically deformed by said terminal, and wherein said retainer arm extends from the inner surface of an upper wall of said chamber to a free end facing the direction opposing the insertion of said spacer; said terminal being insertable in an opening opposite that of said spacer and below said retainer arm, whereby insertion of said terminal deforms said retainer arm toward said upper wall during insertion thereof, until complete insertion frees said retainer arm to relax elastically and lock said terminal in a fully inserted position.

2. An electrical connector as claimed in claim 1, wherein said spacer is generally U-shaped, having a base and two parallel arms extending from opposite ends of said base towards distal ends thereof; said spacer being elastically deformable such that said distal ends move close together when inward pressure is applied to said spacer arms.

3. An electrical connector as claimed in claim 2, wherein said deformation element comprises a pair of projections in opposite side walls of said chamber; said projections positioned in the path of insertion of said spacer to deform said spacer as it is inserted into said chamber.

4. An electrical connector as claimed in claim 3, wherein said spacer arms have respective slots therein shaped and positioned to mate with said projections when said spacer is in a fully inserted position in said chamber, thereby allowing said spacer arms to resume their non-deformable position.

5. An electrical connector as claimed in claim 4, further comprising guide means in said chamber for guiding the insertion of said spacer at a position whereby said spacer will enter said space if said retainer arm is not deformed by a partially inserted terminal, but will abut said retainer when both said retainer and said spacer are deformed, thereby blocking said spacer from complete insertion into said chamber.

6. An electrical connector as claimed in claim 5, wherein said spacer arms have an additional pair of respective slots for mating with said projections; said additional pair of slots being closer to said spacer arm distal ends than said other pair of slots, whereby said spacer arm is temporarily locked into a partially inserted position when said additional slots are receiving said projections.

* * * * *